US006112676A

United States Patent [19]

Okazaki et al.

[11] Patent Number: 6,112,676

[45] Date of Patent: Sep. 5, 2000

[54] PULVERIZED COAL BURNER

[75] Inventors: Hirofumi Okazaki; Hironobu Kobayashi, both of Hitachi; Toshikazu Tsumura, Kure; Kenji Kiyama, Kure; Tadashi Jimbo, Kure; Kouji Kuramashi, Kure; Shigeki Morita, Aki-ku; Shin-ichiro Nomura, Kure; Miki Shimogori, Kure, all of Japan

[73] Assignees: Hitachi, Ltd.; Babcock Hitachi K.K., both of Tokyo, Japan

[21] Appl. No.: 09/115,736

[22] Filed: Jul. 15, 1998

[30] Foreign Application Priority Data

Jul. 24, 1997 [JP] Japan ..... 9-198489

[51] Int. Cl.[7] ..... F23C 1/12; F23D 1/02

[52] U.S. Cl. ..... 110/261; 110/262; 110/264; 431/185; 431/187

[58] Field of Search ..... 110/260, 261, 110/262, 263, 264, 265; 431/104 B, 182, 183, 184, 185, 187

[56] References Cited

U.S. PATENT DOCUMENTS

| | | | |
|---|---|---|---|
| 4,241,673 | 12/1980 | Smith et al. | 110/347 |
| 4,539,918 | 9/1985 | Beer et al. | 110/266 |
| 4,545,307 | 10/1985 | Morita et al. | 110/264 |
| 4,726,760 | 2/1988 | Skoog | 431/8 |
| 4,741,279 | 5/1988 | Azuhata et al. | 110/347 |
| 4,807,541 | 2/1989 | Masai et al. | 110/262 |
| 4,930,430 | 6/1990 | Allen et al. | 110/264 |
| 5,090,339 | 2/1992 | Okiura et al. | 110/263 |
| 5,231,937 | 8/1993 | Kobayashi et al. | 110/262 |
| 5,263,426 | 11/1993 | Morita et al. | 110/265 |
| 5,603,906 | 2/1997 | Lang et al. | 422/182 |
| 5,680,823 | 10/1997 | LaRose | 110/262 |
| 5,700,143 | 12/1997 | Irwin et al. | 431/284 |
| 5,806,443 | 9/1998 | Koayashi et al. | 110/262 |
| 5,829,369 | 11/1998 | Sivy et al. | 110/347 |
| 5,878,676 | 3/1999 | Jochem et al. | 110/261 |

FOREIGN PATENT DOCUMENTS

| | | | |
|---|---|---|---|
| 260382 | 3/1988 | European Pat. Off. . | |
| 0 314 928 A1 | 5/1989 | European Pat. Off. . | |
| 409102 | 7/1989 | European Pat. Off. . | |
| 0 445 938 A1 | 9/1991 | European Pat. Off. . | |
| 672863 | 3/1994 | European Pat. Off. . | |
| 690 264 | 1/1996 | European Pat. Off. . | |
| 0 809 068 A2 | 11/1997 | European Pat. Off. . | |
| 59-86809 | 5/1984 | Japan | 110/347 |
| 62-172105 | 7/1987 | Japan . | |
| 1-305206 | 12/1989 | Japan | F23D 1/00 |
| 3-110308 | 5/1991 | Japan | F23D 1/00 |
| 3-211304 | 9/1991 | Japan | F23D 1/00 |
| 9-26112 | 1/1997 | Japan . | |
| 2038535 | 6/1995 | Russian Federation . | |
| 2062946 | 6/1996 | Russian Federation . | |
| 2070761 | 2/1981 | United Kingdom . | |
| WO95/13502 | 5/1995 | WIPO . | |
| 98/21424 | 5/1998 | WIPO . | |

*Primary Examiner*—Ira S. Lazarus
*Assistant Examiner*—Ljiljana V. Ciric
*Attorney, Agent, or Firm*—Mattingly, Stanger & Malur, P.C.

[57] ABSTRACT

A pulverized coal burner includes a pulverized coal nozzle for jetting a mixture of pulverized coal and primary air, a secondary air nozzle and a tertiary air nozzle, concentrically arranged around the outer periphery of the pulverized coal nozzle, and a tube expanded portion at the end of a partition wall separating two adjacent air nozzles. A flow shift means such as a guide plate for shifting the secondary air in the secondary air nozzle so as to flow along the tube expanded portion is provided. The secondary air is jetted outwardly by the guide plate, and mixing of the secondary air and the tertiary air with pulverized coals is delayed, whereby an amount of NOx is decreased.

14 Claims, 5 Drawing Sheets

PULVERIZED COAL BURNER

BACKGROUND OF THE INVENTION

The present invention relates to a pulverized coal burner which is a type of pulverized coal float-firing burner and, more particularly, to a pulverized coal burner suitable for lowering the concentration of nitrogen oxides (hereunder, referred to as NOx).

In general, for burners, suppression of NOx formation during combustion is a subject matter to be solved. Particularly, coal includes a larger amount of nitrogen, compared with gaseous fuel and liquid fuel. Therefore, it is more important to decrease NOx produced by combustion of pulverized coals than in a case of combustion of gaseous fuel or liquid fuel.

NOx produced by combustion of pulverized coals is almost all NOx that is produced by oxidizing nitrogen contained in coal, that is, so-called fuel NOx. In order to decrease the fuel NOx, various burner structures and burning methods have been studied.

As one of the burning methods, there is a method forming a low oxygen concentration region within a flame and reducing (deoxidizing) NOx. For example, JP A 1-305206 (U.S. Pat. No. 4,930,430), JP A 3-211304, JP A 3-110308, U.S. Pat. No. 5,231,937, U.S. Pat. No. 5,680,823, etc. disclose a method of producing a flame of low oxygen concentration atmosphere and completely burning coal, and a structure having a fuel nozzle for pneumatically transferring coal at the center thereof and an air injecting nozzle arranged outside the fuel nozzle. According to this prior art, a reducing flame region of a low oxygen concentration is formed within the flame, reducing reactions of NOx are progressed in the reducing flame region, and an amount of NOx occurred within flame is suppressed to be small. Further, JP A 1-305206 discloses a method of stabilization of flame by providing, at an outlet end portion of a nozzle, an obstacle against the flow direction of gas. Further, JP A 3-311304, JP A 3-110308 and U.S. Pat. No. 5,231,937 disclose stabilization of flame by providing a flame stabilizing ring at the tip of a pulverized coal nozzle. According to this prior art, recirculating zones are formed downstream of the tip of the pulverized coal nozzle by providing the flame stabilizing ring or obstacle at the tip of the pulverized coal nozzle. Since a high temperature gas stays in the recirculating zones, ignition of pulverized coals progresses and the stability of the flame can be raised.

However, in the above-mentioned prior art, NOx formation has not been sufficiently suppressed as yet.

SUMMARY OF THE INVENTION

An object of the invention is to provide a pulverized coal burner which can further decrease NOx formation by solving the above-mentioned problems of the prior art.

The present invention is characterized in that, in a pulverized coal burner comprising a pulverized coal nozzle for jetting or spouting a mixture of pulverized coals and primary air, a secondary air nozzle concentrically arranged around the outer periphery of the pulverized coal nozzle, a tertiary air nozzle concentrically arranged around the outer periphery of the secondary air nozzle and an expanded portion formed at the end of an outer peripheral wall of the secondary air nozzle, a flow shift means is provided for shifting secondary air jetted from the secondary air nozzle toward the radially outer side so that the secondary air flows along the expanded portion.

The pulverized coal burner in which the secondary air nozzle and tertiary air nozzle are concentrically arranged around the outer periphery of the pulverized coal nozzle aims to suppress NOx formation by forming a NOx reducing zone of a low oxygen concentration by primary air and to carry out complete combustion by forming an oxidizing flame region by mixing the secondary air and tertiary air with the flow at a downstream side of the NOx reducing region. The later the mixing of the secondary air and tertiary air with pulverized coals becomes, the larger the NOx reducing zone is formed, so that an effect of suppressing the NOx formation can be increased. On the other hand, pulverized coal itself is not good in ignitability, and under the condition that oxygen is short, the pulverized coal is difficult to ignited but the flame is easily extinguished. In order to stably form flame under the condition of air shortage, it is desirable to pull a high temperature combustion gas present in the after flow of the flame to a position close to the outlet of the pulverized coal nozzle. By forming a low pressure portion at a downstream side of the tip of a partition wall separating or partitioning the pulverized coal nozzle and the secondary air nozzle, a recirculating zone is formed there, and the high temperature combustion gas is pulled back. When the recirculating zone is formed, air flowing outside the recirculating zone has a tendency to be pulled to the inside by the recirculating zone. However, if the recirculating zone is formed to spread in a perpendicular direction to the axis of the pulverized coal nozzle and be large in the axial direction, the air flowing outside the recirculating zone becomes slow in pullback and does not flow back close to the outlet of the pulverized coal nozzle.

According to the present invention, since secondary air comes to flow outwardly along the expanded portion of the tip of the outer peripheral wall of the secondary air nozzle, the size of the recirculating zone formed at a downstream side of the partition wall separating the pulverized coal nozzle and the secondary air nozzle becomes large, whereby pullback of the secondary air becomes slow. Further, by a large-sized recirculating zone, the ignitability of pulverized coals becomes good and flame becomes difficult to be extinguished.

As the above-mentioned flow shift means, it is preferable to provide a guide plate at the tip of the inner peripheral wall of the secondary air nozzle. An angle of the guide plate should be sharper than that of an expanded portion provided on the outer peripheral wall of the secondary air nozzle.

As the flow shift means, a gas jet nozzle for jetting a gas toward the secondary air flowing in the vicinity of the outlet of the secondary air nozzle and shifting the secondary air to the radially outer side can be used rather than the guide plate. Further, an induction member for inducing or guiding the flow of secondary air flow toward the outside can be used therefor. Still further, it also is possible to shift the secondary air toward the radially outer side by providing a swirler at the outlet of the secondary air nozzle and using the swirling force of the swirler. It is very desirable to provide the guide plate at the tip of the inner peripheral wall of the secondary air nozzle, and the effect of shifting the secondary air to the radially outer side is very large.

The angle of the above-mentioned guide plate is in a range of 60 to 90° against the central axis of the pulverized coal nozzle, and a range of 80 to 90° is more desirable. In this manner, by arranging the guide plate at a sharp angle against the central axis of the burner, an effect of shifting secondary air to the radially outer side becomes large, a recirculating zone also is formed at a downstream side of the guide plate and pullback of secondary air and tertiary air can be made slower.

The tip of the guide plate is preferably positioned downstream of the tip of the expanded portion provided on the outer peripheral wall of the secondary air nozzle. By such an arrangement, after the secondary air flowing in the secondary air nozzle flows out of the nozzle, the flow direction is changed outwardly, and the secondary air flows toward the tertiary air flow so as to impinge thereon. Thereby, the flow of tertiary air comes to be shifted further outwardly, and mixing of the tertiary air is delayed. The tip of the guide plate and the tip of the expanded portion are desirable to be separated by a distance in a range of from 5 mm or more to 50 mm or less. When the distance is too small, the effect is small, and when too large, the secondary air expands after leaving the nozzle and the velocity of the flow becomes slow, whereby an effect of shifting the tertiary air toward the outside becomes small.

The tip of the guide plate also is desirable to be positioned at an upstream side of the tip of the outer peripheral wall of the tertiary air nozzle. The outer peripheral wall, usually, jointly served as a furnace wall of a boiler in many cases. Combustion and slag are adhered to the furnace wall, and the substances and slug, in a case of a large amount, may reach to from several kg to several hundred kg. In order to prevent the burner from being broken by the fall of the substances and a slag, the tip of the guide plate is preferable not to project into the inside of the furnace from the furnace wall which jointly serves as the outer peripheral wall of the tertiary air nozzle.

For the tertiary air nozzle, it is preferable that an outward force has been already applied when the tertiary air is jetted from the tertiary air nozzle. Therefore, it is preferable to provide a swirler inside the tertiary air nozzle. Further, it is preferable to have an outwardly expanded end portion of the outer peripheral wall of the tertiary air nozzle. Still further, it is preferable to have an outwardly expanded the end portion of the inner peripheral wall of the tertiary air nozzle.

By making the burner so that secondary air flows along the expanded portion provided on the outer peripheral wall of the secondary air nozzle, a recirculating zone is unlikely to be formed between the secondary air nozzle and the tertiary air nozzle, whereby pullback of the tertiary air also becomes slow.

Although a conventional burner in which an expanded portion is provided at the tip of the outer peripheral wall of a secondary air nozzle has been known, in the conventional burner, such a device that shifts secondary air to the radially outer side was not utilized. Therefore, most of the secondary air was easy to flow in the axial direction of the burner according to the inertia of the air. As a result, the conventional burner has a defect that a recirculating zone between the pulverized coal nozzle and the secondary air nozzle becomes small. Further, a recirculating zone is easily formed between the secondary air nozzle and the tertiary air nozzle, and the secondary air and tertiary air are easy to mix with a reducing flame in an earlier stage. By taking a countermeasure for shifting a secondary air flow to the radially outer side as in the present invention, it becomes possible to delay mixing of secondary air and tertiary air with pulverized coals and form a large NOx reducing zone. Further, by a large recirculating zone between the pulverized coal nozzle and the secondary air nozzle, the ignitability of pulverized coals is improved. Additionally, such an effect can be attained that an air-deficient NOx reducing zone is stably formed.

It is desirable to further provide, within the secondary nozzle, a flow path narrowing member or obstacle for narrowing the flow path of the secondary air nozzle to make the flow velocity faster. It is possible to direct the flow of tertiary air to a further outward direction by changing, by the guide plate, the flow direction of the secondary air made faster in flow velocity by the flow path narrowing obstacle, and then spouting it from the secondary air nozzle. The flow path narrowing obstacle can be provided at the inner peripheral wall or outer peripheral wall of the secondary air nozzle. However, it is preferable for it to be provided at the inner peripheral wall side, because it is possible to more rapidly change the direction of a secondary air flow to an outward direction.

The present invention can be applied to a pulverized coal burner having a flame stabilizing ring at the outer periphery of the tip of a pulverized coal nozzle in order to improve the ignitability of pulverized coals. Further, it is possible to form slits in the flame stabilizing ring or in the guide plate provided at the tip of inner peripheral wall of the secondary air nozzle. The slits have an effect of suppressing thermal deformation of the flame stabilizing ring or the guide plate. Further they have an effect of making it easy to form a recirculating zone at a downstream side of the flame stabilizing ring or the guide plate.

BRIEF DESCRIPTION OF THE DRAWINGS

FIGS. 1(*b*) and 1(*c*) each are an enlarged view of a part of FIG. 1(*a*);

DESCRIPTION OF EMBODIMENTS OF THE INVENTION

Figure 1:
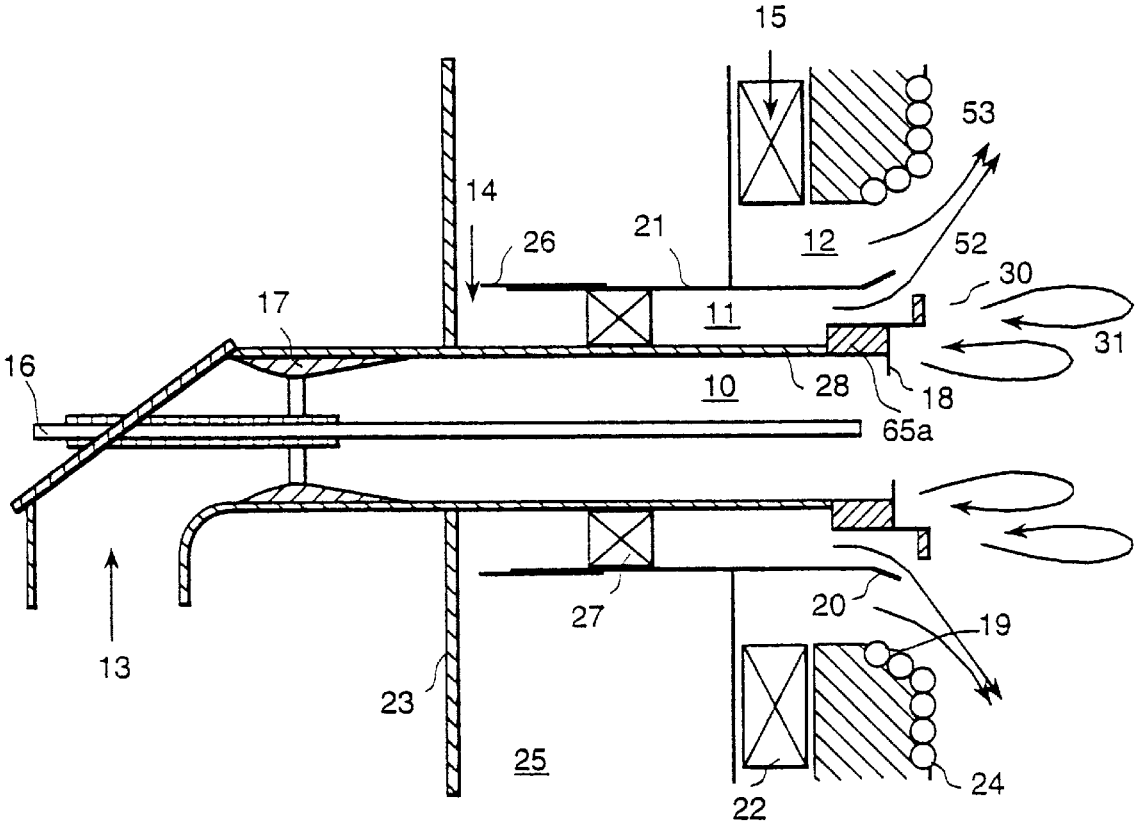
FIG. 1(*a*) is a sectional view of a pulverized coal burner of a first embodiment of the present invention.
Figure 1:
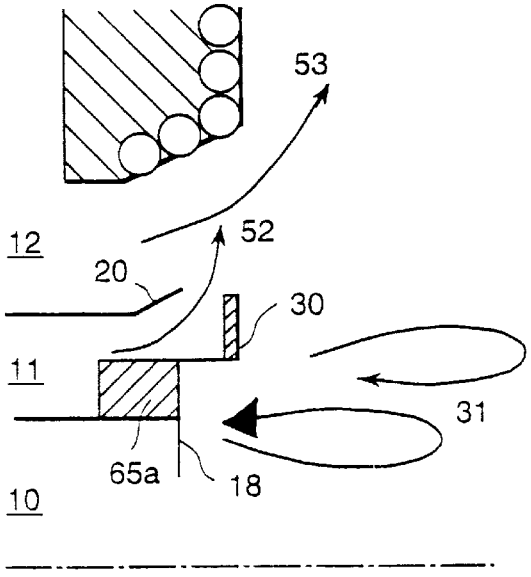
Figure 1:
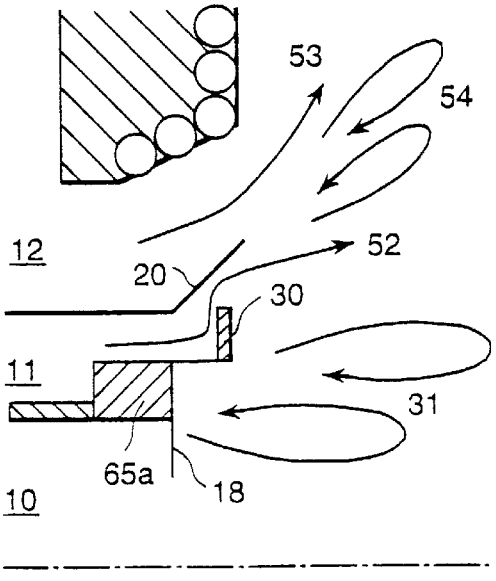
Figure 2:
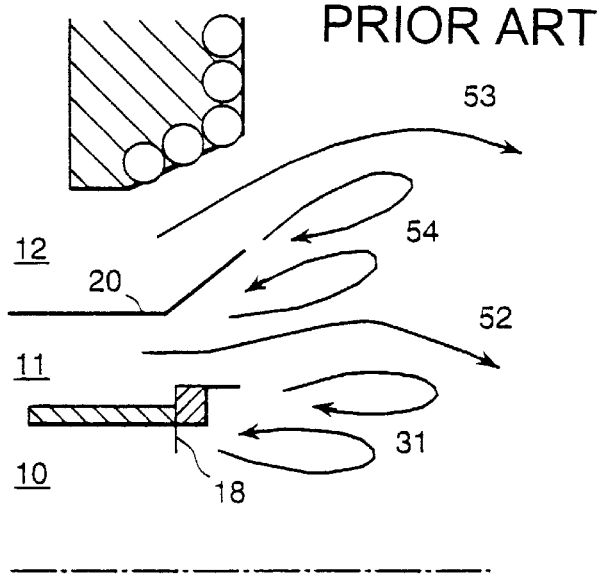
FIG. 2 PRIOR ART
FIG. 2 is a sectional view of an end portion of a nozzle of a conventional pulverized coal burner, which is shown for caparison with the first embodiment of the present invention.

A first embodiment of the present invention is described hereunder, referring to FIGS. 1(*a*), 1(*b*) and 1(*c*) and FIG. 2.

FIG. 1(*a*) is a schematic illustration of a section of a pulverized coal burner of the present embodiment, and FIGS. 1(*b*) and 1(*c*) each are an enlarged view of a part of FIG. 1(*a*) for explaining air flow and recirculating zone in a nozzle end region shown in FIG. 1(*a*).

In FIGS. 1(*a*), 1(*b*) and 1(*c*), 10 denotes a pulverized coal nozzle which is connected to a transfer tube (not shown) at an upstream side and transfers and supplies pulverized coals together with primary air. 11 denotes a secondary air nozzle for jetting secondary air. The secondary air nozzle 11 has a flow path formed around the outer periphery of the pulverized coal nozzle 10 and is shaped in a circular cross-section which is concentric with the pulverized coal nozzle 10. 12 denotes a tertiary air nozzle for jetting tertiary air, which has a flow path formed around the outer periphery of the secondary air nozzle 11 and is shaped in a circular cross-section which is concentric with the secondary air nozzle 11. A flow rate distribution among primary air, secondary air and tertiary air is 1–2: 1:3–7, for example, and the distribution is made so that the pulverized coals are completely burnt by the tertiary air. 13 denotes inflowing pulverized coals and primary air. 14 and 15 denote inflowing secondary air and tertiary air, respectively. 16 denotes an oil gun provided in the pulverized coal nozzle 10 so as to axially extend to a position in the vicinity of the outlet of the nozzle 10. The oil gun 16 is used for assisting combustion at the time of burner starting or low load combustion. 17 denotes a venturi tube making small the inner diameter of the pulverized coal nozzle 10 to prevent the pulverized coals from backfiring. 18 denotes a flame stabilizing ring provided at the end of a partition wall 28 partitioning the pulverized coal nozzle 10 and the secondary air nozzle 11 and separating the primary air and secondary air to expand a recirculating zone 31. 19 denotes a burner throat forming a furnace wall and also serves as an outer peripheral wall of the tertiary nozzle 12. 20 denotes a guide sleeve provided at the end of a partition wall 21 separating the secondary air nozzle 11 and the tertiary air nozzle 12, which sleeve also is referred to as a tube expanded portion in the present invention. 22 denotes a swirler for swirling tertiary air along the periphery of the secondary air nozzle 11. The swirler 22 employs air swirling vanes usually called resistor vanes in this embodiment. 23 denotes a side plate for inflowing secondary air. 24 denotes water pipes provided on the furnace wall 19. 25 denotes a wind box in which secondary air is introduced. 26 denotes a damper for adjusting secondary air. 27 denotes a swirler for swirling secondary air along the periphery of the pulverized coal nozzle, and the swirler 27 employs air swirling vanes usually called vanes in this embodiment. 28 denotes the partition wall between the pulverized coal nozzle 10 and the secondary air nozzle 11. 30 denotes a guide plate provided at the end of the inner peripheral wall of the secondary air nozzle 11 for jetting the secondary air toward the radially outer side. 31 denotes the recirculating zones formed between jetting regions of the pulverized coal nozzle 10 and the secondary air nozzle 11. 52 denotes a secondary air flow. 53 denotes a tertiary air flow. 65*a* denotes an obstacle (for flow path narrowing) which is a part of the flame stabilizing ring 18 and is provided in the inner peripheral portion of the secondary air nozzle 11.

FIG. 2 is an enlarged view for explaining air flows and recirculating zones in a nozzle end region of a conventional pulverized coal burner, which is shown for comparing it with the pulverized coal burner in FIG. 1(*b*). The structure shown in FIG. 2 differs from that shown in FIG. 1(*a*) in that the guide plate is not provided.

Next, a burning operation of the present embodiment will be described, referring to FIGS. 1(*a*) and 1(*b*).

As the pulverized coal burner starts up combustion, since the air downstream of the partition wall 28 is taken from the air jetted from each nozzle, the pressure downstream of the partition wall 28 decreases, and a recirculating zone 31 is formed. Since the flame stabilizing ring 18 is provided at the end portion of the partition wall 28, primary air and secondary air are separated from each other, and the recirculating zone 31 expands. Since a high temperature gas stays within the recirculating zone 31, ignition of pulverized coals progresses, and the stability of the flame is improved. Thereby, the flame is stably formed by pulverized coals and primary air in the vicinity of the outlet of the pulverized coal nozzle 10. Further, consumption of oxygen progresses within the flame, a NOx reducing zone expands and it is possible to decrease an amount of NOx formation. Further, since the combustion of coal progresses, unburnt carbon in combustion ashes left after combustion decreases. Further, since the swirlers 22, 27 are provided, secondary air and tertiary air are jetted as swirling flows, the negative pressure downstream of the flame stabilizing ring 18 is raised by the centrifugal force of the air, and the recirculating zone expands further. Thereby, mixing of the secondary air and tertiary air with the pulverized coals in the vicinity of the burner is delayed, and the concentration of oxygen within the flame decreases, so that the NOx reducing zone expands.

In the present embodiment, further, since the guide plate 30 is provided at the end portion of the inner peripheral wall of the secondary air nozzle 11 as a means for deflecting a secondary air flow 52 jetted from the secondary air nozzle 11 toward the radially outer side, the secondary air is jetted in a direction of radially outer side, the mixing of the secondary air and tertiary air with the pulverized coals is delayed further, and the recirculating zone downstream of the flame stabilizing ring 18 expands. Therefore, the combustion of the pulverized coals in this recirculating zone region is promoted, and NOx formtion and unburnt carbon can be decreased further.

The combustion conditions at this time will be explained, by comparison with the conventional structure in FIG. 2 in which the guide plate is not provided.

In FIG. 2, the flow path of tertiary air 53 is bent by the guide sleeve 20 formed in a tapered cylindrical shape, and the tertiary air is jetted outward. On the other hand, the flow path of the secondary air nozzle 11 is expanded outward at the nozzle outlet by the guide sleeve 20. Since air flows straight by its inertia, secondary air is apt to flow along the burner axis (a dashed line in FIG. 2), and there occurs a pressure drop in a reverse direction (hereafter, referred to as an adverse pressure gradient) to a jetting direction of air flow along the guide sleeve 20, whereby a recirculating zone 54 is formed downstream of the guide sleeve 20. By this recirculating zone 54, a flow directed to the center (the dashed line in FIG. 2) is induced in the tertiary air 53, and the tertiary air is mixed early with the pulverized coals, so that the NOx reducing zone is narrowed.

On the contrary, in the present embodiment, as shown in FIG. 1(*b*), secondary air 52 is jetted in an outer peripheral direction by the guide plate 30. Therefore, formation of a recirculating zone at a downstream side of the guide sleeve 20 separating the secondary air nozzle 11 and the tertiary air nozzle 12 is prevented or suppressed. Further, in particular, since the burner is constructed so that the secondary air 52 is jetted more outward than tertiary air 53, the flow of the tertiary air 53 is further directed to the outer peripheral direction by the momentum of secondary air 52 jetted in the outer peripheral direction. Therefore, mixing of the secondary air and tertiary air with the pulverized coals in the vicinity of burner is delayed, the concentration of oxygen within the flame is lowered, and the NOx reducing zone expands, whereby NOx occurred within the flame can be decreased.

Further, since the tip of the guide plate 30 is disposed further away from the burner axis (a dashed line in FIG. 1(*b*)) side than the tip of the guide sleeve 20, the secondary air is apt to flow more outward and a recirculating zone is unlikely to occur downstream of the guide sleeve 20.

In this embodiment, the flow path of the secondary air nozzle 11 is narrowed near its outlet by the flame stabilizing ring 18, whereby the secondary air made larger in flow velocity by the flow path narrowing is jetted, so that tertiary air can be further delayed in mixing with coal.

In this manner, according to this embodiment, secondary air is jetted in the radially outer direction from the secondary air nozzle 11 by the guide plate 30 provided on the secondary air nozzle 11. Further, the adverse pressure gradient at the downstream side of the partition wall 21 between the secondary air nozzle 11 and the tertiary air nozzle 12 becomes small, so that tertiary air also is jetted in the radially outer direction from the tertiary air nozzle 12 disposed at the outer periphery side of the secondary air nozzle 11. Therefore, mixing of pulverized coal and combustion air with pulverized coals in the vicinity of the burner is suppressed, and the pulverized coals are burnt in the vicinity of the burner under the condition of low oxygen concentration, whereby an amount of NOx formation can be reduced.

As an example, a combustion test was conducted in a combustion furnace (500 kg/h), using the pulverized coal burner (a distance between the guide sleeve 20 and the guide plate 30 is 10 mm) as shown in FIGS. 1(*a*) and 1(*b*) and the burner shown in FIG. 2. The result is shown in a table 1. The concentration of NOx after combustion by the burner of FIGS. 1(*a*) and 1(*b*) was 103 ppm (6 vol % $O_2$), while the NOx concentration by the burner of FIG. 2 was 111 ppm (6 vol % $O_2$). An effect of decreasing a NOx formation amount by the present invention was acknowledged.

TABLE 1

| Burner Structures | NOx (ppm; 6% vol. $O_2$-concentration basis) | Unburnt Carbon in Ashes (wt %) |
|---|---|---|
| Without Guide Plate (FIG. 2) | 111 ppm | 6.0 |
| With Guide plate (FIG. 1(b)) | 103 ppm | 6.0 |
| With gGuide Plate (FIG. 1(c)) | 107 ppm | 6.o |

Further, FIG. 1(*c*) is an enlarged view of a nozzle end portion for explaining an air flow in a case where the guide plate 30 in FIG. 1(*b*) is shifted toward an upstream side. As in the burner shown in FIG. 1(*c*), in a case where the guide plate 30 is shifted axially to a more upstream side than the tip of the sleeve 20, secondary air 52 flows as shown in FIG. 1(*c*). That is, the secondary air 52 is changed outward in its flow direction by the guide plate 30, however, the flow toward a radially outer side is prevented by the sleeve 20. Therefore, the secondary air jetted from the burner flows directed more to a direction of the central axis than in the case where the guide plate 30 is arranged at a more downstream side in the burner axis direction than the tip of the guide sleeve 20 as shown in FIG. 1(*b*). Therefore, as shown in FIG. 1(*c*), a recirculating zone 54 is apt to be formed in a downstream side of the guide sleeve 20. Flows are induced in the tertiary air 53 by the recirculating zone 54. Since the flows toward the central axis are apt to be induced in the tertiary air 53, mixing between the tertiary air and the pulverized coals is advanced in time and a NOx reducing zone is narrowed.

As an example, using the burner as shown in FIG. 1(*c*) (the tip of the guide plate 30 is positioned at a place upstream of the tip of the guide sleeve 20 by 10 mm in the burner axis direction), a combustion test was conducted at a coal supply rate of 500 kg/h. The result is shown in the table 1. At this time, the NOx concentration at the combustion furnace outlet of the burner shown in FIG. 1(*b*) was 103 ppm (6% oxygen concentration basis), while the NOx concentration by the burner shown in FIG. 1(*c*) was 107 ppm (6% oxygen concentration basis) on the basis of the same unburnt carbon amount, and NOx formation was raised more than in the case where the guide plate 30 is positioned more downstream of the tip of the sleeve in the burner axis direction.

Figure 3:
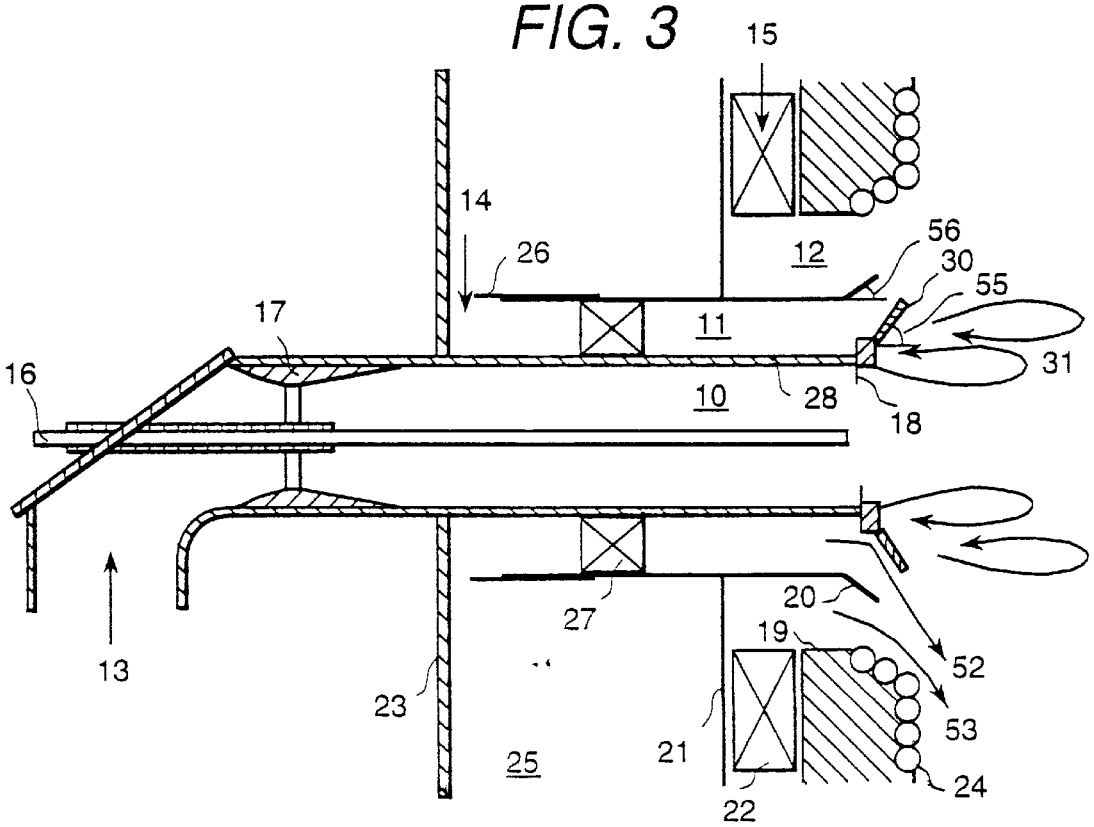
FIG. 3 is a sectional view of a pulverized coal burner of a second embodiment of the present invention.

Next a second embodiment of the present invention is described, referring to FIG. 3.

FIG. 3 is a sectional view of a pulverized coal burner of the second embodiment. This embodiment is different from the first embodiment of FIGS. 1(*a*) and 1(*b*) in that an angle 55 of the guide plate 30 and an angle 56 of the guide sleeve 20 with respect to the central axis of the pulverized coal burner each are made adjustable, and the other structure is the same as that of the first embodiment.

According to this embodiment, by adjusting operation of the angle 55 of the guide plate 30 and the angle 56 of the guide sleeve 20, the angles of the guide plate 30 and guide sleeve 20 are adjusted depending on supply amounts of pulverized coal, primary air and combustion air, whereby it is possible to form a further suitable recirculating zone region and effectively decrease NOx and unburnt carbon, as compared with the first embodiment.

By setting the angle 55 of the guide plate 30 to 60–90°, preferably 80–90°, it is possible to prevent formation of a recirculating zone between secondary air and tertiary air, and to form a large recirculating zone at a downstream side of the guide plate 30.

Figure 4:
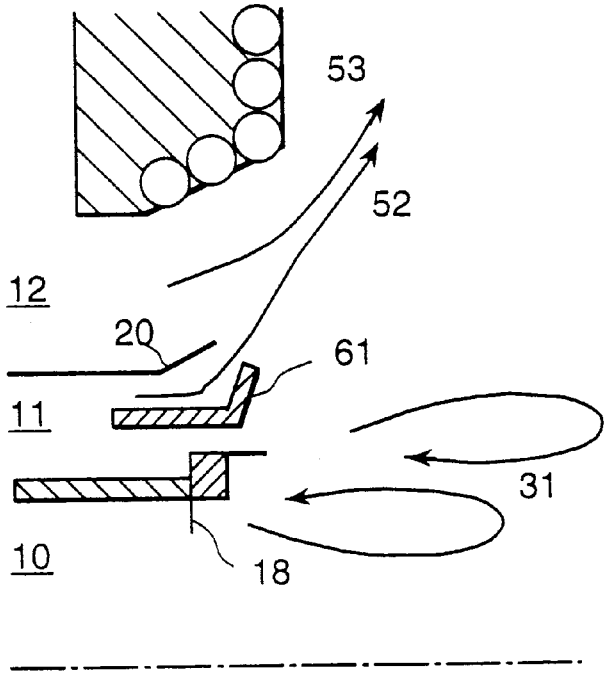
FIG. 4 is a sectional view of a nozzle end portion of a pulverized coal burner of a third embodiment of the present invention.

A third embodiment of the present invention is described, referring to FIG. 4.

FIG. 4 is a sectional view of a nozzle end portion of a pulverized coal burner of the present embodiment. The embodiment is characterized in that a taper shaped ring 61 is provided in an output region of the secondary air nozzle 11 as an induction member for inducing or guiding an air flow jetted from the secondary air nozzle 11 to the radially outer side of the secondary air nozzle 11, as shown in FIG. 4. The other structure is approximately the same as that of the first embodiment.

In this embodiment, an effect that the ring 61 induces a part of secondary air to the outside along the guide sleeve 20 is caused. Therefore, tertiary air 53 flows toward the outer periphery, mixing of secondary air and tertiary air with pulverized coal in the vicinity of the burner is delayed, the concentration of oxygen within flame decreases, and a NOx reducing zone within the flame expands, whereby it is possible to effectively decrease NOx and unburnt carbon.

Figure 5:
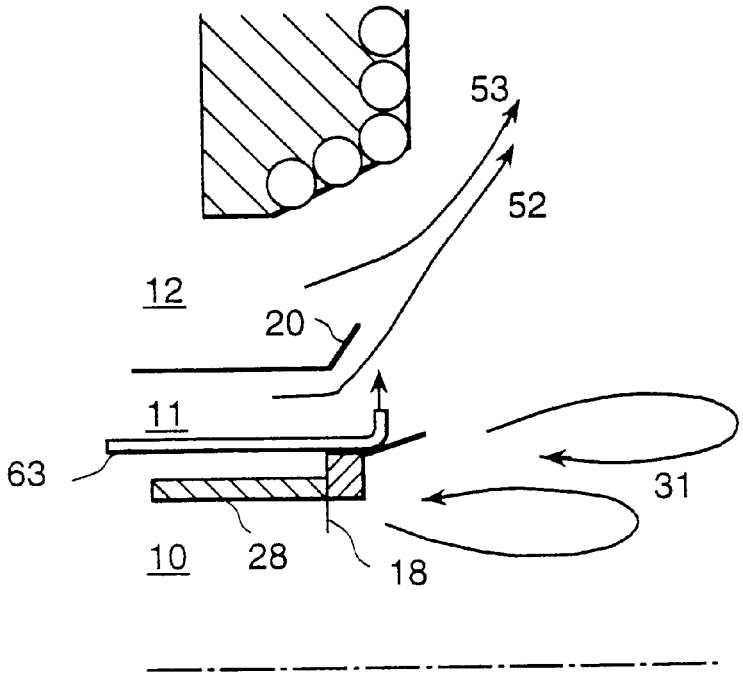
FIG. 5 is a sectional view of a nozzle end portion of a pulverized coal burner of a fourth embodiment of the present invention.

A fourth embodiment of the present invention is described, referring to FIG. 5.

FIG. 5 is a sectional view of a nozzle end portion of a pulverized coal burner of the present embodiment.

The present embodiment is characterized in that a gas jet nozzle 63 for jetting a gas toward the radially outer side is provided within the secondary air nozzle 11 or in a region of the nozzle outlet as a means for deflecting a secondary air flow jetted from the secondary air nozzle 11 toward the radially outer side of the secondary air nozzle 11, as shown in FIG. 5. The other structure is approximately the same as that of the first embodiment. As the gas, air, combustion exhaust gas, inert gas such as nitrogen, steam, etc. can be used.

According to this embodiment, secondary air jetted from the secondary air nozzle 11 flows along the outer periphery by the momentum of the gas jetted from the gas jet nozzle 63. In order to make the momentum large, it is desirable that the flow velocity of gas jetted from the gas jet nozzle 63 is faster than the flow velocity of air jetted from the secondary air nozzle 11. With the burner of this structure, the recirculating zone formed downstream of the partition wall 28 expands, ignition of pulverized coals is promoted by the recirculating zone, and consumption of oxygen progresses, whereby it is possible to expand a region of a low oxygen concentration atmosphere within the flame and to effectively decrease NOx and unburnt carbon.

Figure 6:
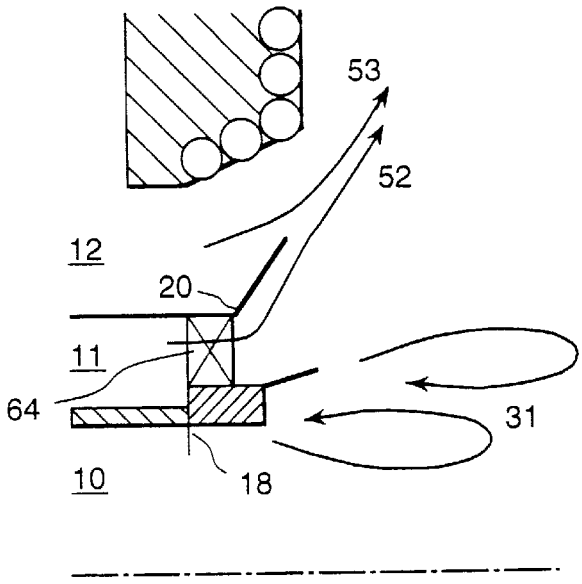
FIG. 6 is a sectional view of a nozzle end portion of a pulverized coal burner of a fifth embodiment of the present invention.

A fifth embodiment of the present invention is described, referring to FIG. 6.

FIG. 6 is a sectional view of a nozzle end portion of a pulverized coal burner of this embodiment.

The present embodiment is characterized in that swirling vanes 64 as a swirler for secondary air are provided in the outlet of the secondary air nozzle 11 as a means for deflecting a secondary air flow jetted from the secondary air nozzle 11 toward the radially outer side of the secondary air nozzle 11, as shown in FIG. 6. The other structure is approximately the same as that of the first embodiment.

In this embodiment, the secondary air is swirled by the swirling vanes 64 and air flow is deflected toward the radially outer side by centrifugal force. Thereby, the secondary air is jetted toward the radially outer side along the guide sleeve 20, and guided to the radially outer side, whereby a more suitable recirculating zone region is formed and it is possible to effectively decrease NOx and unburnt carbon.

As mentioned above, in each of the pulverized coal burners of the above-mentioned embodiments, since a means for deflecting the secondary air jetted from the secondary air nozzle toward the radially outer side of the secondary air nozzle is provided, the secondary air flows toward the radially outer side, and a recirculating zone becomes unlikely to be formed downstream of the partition wall partitioning the secondary air nozzle and the tertiary air nozzle positioned at the outer periphery side of the secondary air nozzle. In the region of the recirculating zone, pressure drop in a reverse direction to a jetting direction of air flow (adverse pressure gradient) is caused. Therefore, air flowing along the recirculating zone changes in flow direction by the adverse pressure gradient and air flowing outside the recirculating zone is apt to flow toward the primary air side. However, in the present invention, since the secondary air is jetted toward the radially outer side, the primary air and secondary air are separated from each other and flow as they are separated. Therefore, the adverse pressure gradient becomes strong at the downstream side of the partition wall of the pulverized coal nozzle and the secondary air nozzle, and the recirculating zone formed in the region of the adverse pressure gradient expands. In the recirculating zone formed between the primary air and the secondary air, a high temperature gas stays, and stabilizes the ignition of pulverized coal and flame. Expansion of the recirculating zone promotes ignition of pulverized coal by the high temperature gas. Since consumption of oxygen progresses by the ignition, a region of low oxygen concentration atmosphere within the flame expands, whereby it is possible to decrease an amount of NOx formation and an amount of unburnt carbon in the combustion ashes.

Further, since the stability of ignition of pulverized coal and flame is improved, an effect that a distance necessary for combustion is shortened and the apparatus itself can be small-sized is attained. Further, since flame becomes stable even in a case where the concentration of pulverized coal becomes small as at the time of low load operation, a possible range of combustion of only pulverized-coals by the pulverized coal burner without assistance of any other kinds of fuel is expanded.

Figure 7:
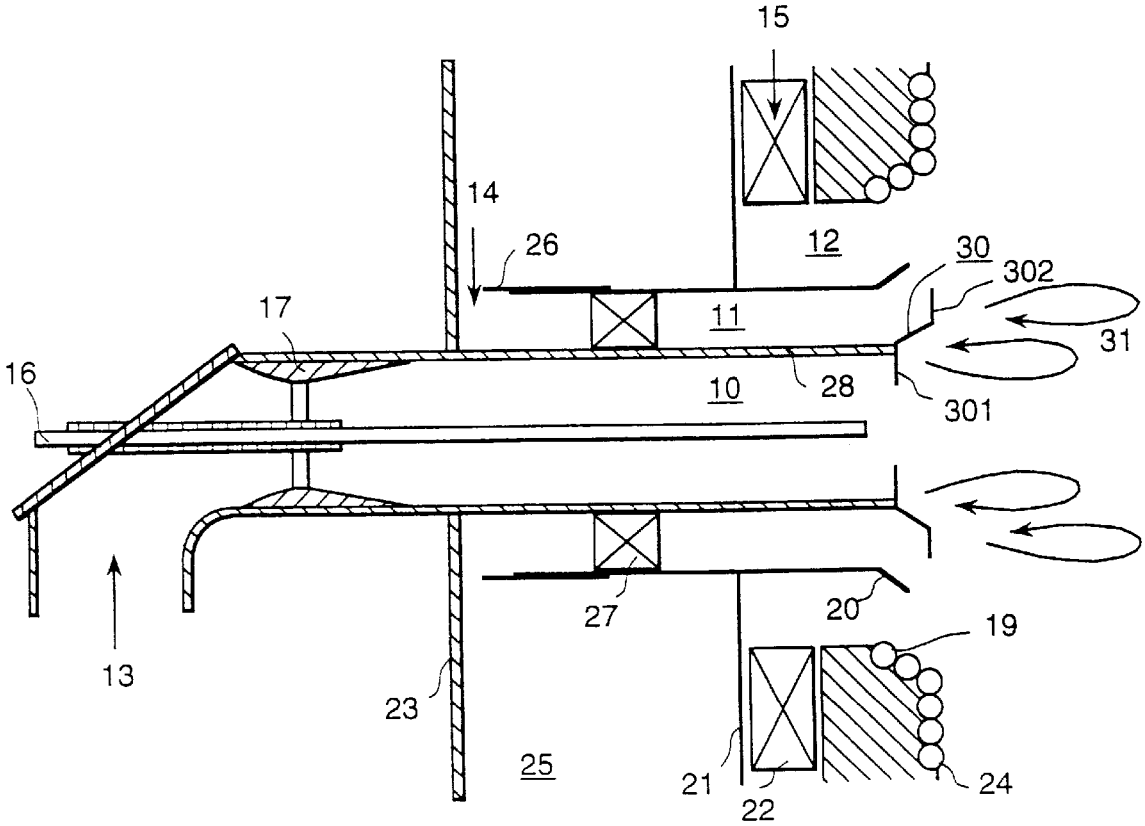
FIG. 7 is a sectional view of a pulverized coal burner of a sixth embodiment of the present invention.

A sixth embodiment of the present invention is described, referring to FIG. 7.

FIG. 7 is a sectional view of a pulverized coal burner of the present embodiment.

The embodiment is characterized in that a ring 30 having a plane perpendicular to directions of a primary air flow and secondary air flow is provided at the end portion of the partition wall 28 as a means for deflecting a secondary air flow jetted from the secondary air nozzle 11 to the radially outer side of the secondary air nozzle 11 and forming a recirculating zone at a downstream side of the partition wall 28, as shown in FIG. 7. The other structure is approximately the same as that of the first embodiment.

In FIG. 7, the ring 30 is formed of an inner ring 301 formed at the side of the pulverized coal nozzle 10 and an outer ring 302 formed in the side of the secondary air nozzle 11. The ring 30 causes turbulence in the primary air and secondary air, whereby the recirculating zone formed downstream of the ring 30 develops. In this embodiment, further, the positions of the inner ring 301 and outer ring 302 are separated from each other in the flow direction. As a result, in the recirculating zone formed downstream of the ring 30, slippage (or difference)in flow direction occurs between the pulverized coal flow side and the air flow side, and the recirculating zone 31 is formed so as to extend in the flow direction and so that gas is rolled back from the downstream side.

According to the present invention, in this manner, the recirculating zone region can be expanded, and the region of low oxygen concentration atmosphere within the flame also can be expanded, so that an amount of NOx formation and an amount of unburnt carbon in the combustion ashes can be effectively decreased.

Further, it is possible to improve the ignition of pulverized coals and the stability of flame, and to shorten the distance necessary for combustion. Further, since the flame is stabilized even in a case where the concentration of pulverized coal decreases as at the time of combustion under a low load, a range in which it is possible to burn only pulverized coals by the pulverized coal burner is expanded.

Figure 8:
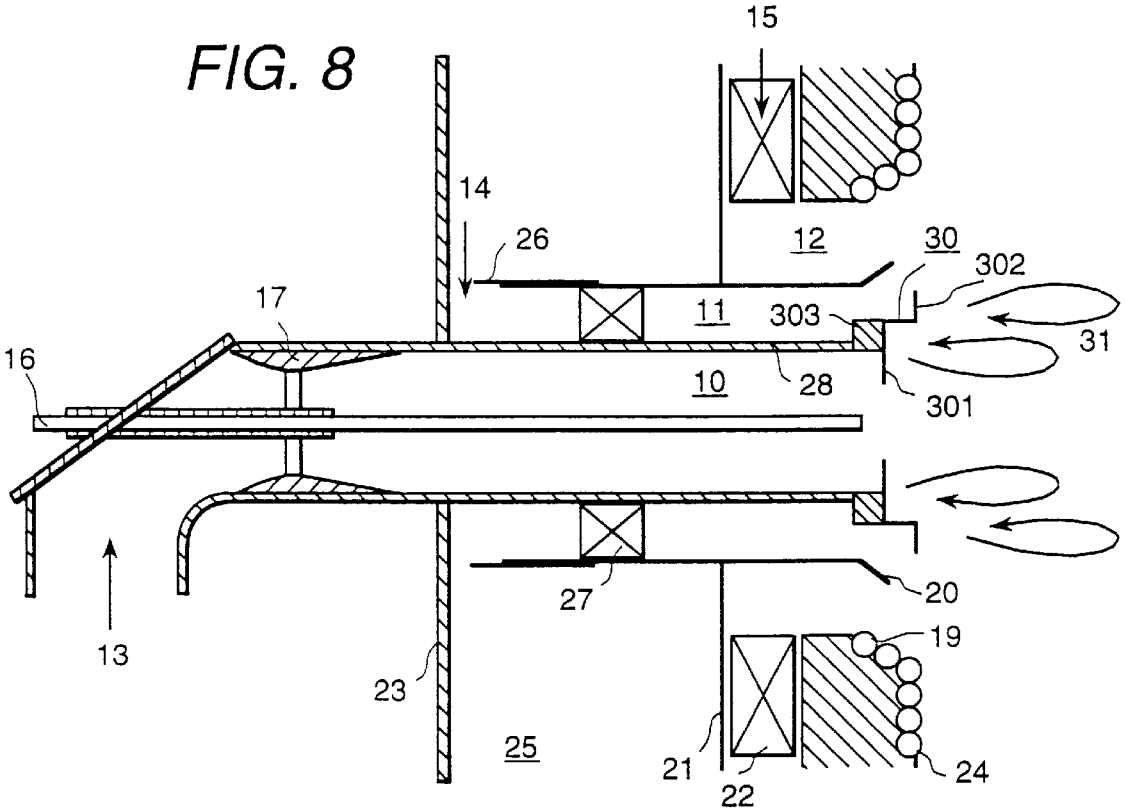
FIG. 8 is a sectional view of a pulverized coal burner of a seventh embodiment of the present invention.

A seventh embodiment of the present invention is described, referring to FIG. 8.

FIG. 8 is a sectional view of a pulverized coal burner of the seventh embodiment.

This embodiment is characterized in that the ring 30 provided at the end portion of the partition wall 28 is provided with a large thickness portion 303 (10 mm thick, for example) at the secondary air nozzle inner wall side of the ring 30, as a means for deflecting a secondary air flow jetted from the secondary air nozzle 11 to the radially outer side of the secondary air nozzle 11 and forming a recirculating zone at a downstream side of the partition wall 28, as shown in FIG. 8. The other structure is approximately the same as that of the sixth embodiment.

According to this embodiment, the flow path of the secondary air nozzle 11 is narrowed by the large thickness portion 303, the secondary air is made faster in velocity when the air passes at the large thickness portion 303, the air impinges on the outer ring 302, and then it is jetted radially to the outer side. As a result, it is possible to form an expanded a recirculating zone 31, and expand the region of low oxygen concentration atmosphere within the flame, so that an amount of NOx formation and unburnt carbon in the combustion ashes can be effectively decreased, and it is possible to improve the ignition of pulverized coal and the stability of flame.

Further, in each of the sixth and seventh embodiments, the outer ring 302 of the ring 30 is made in a uniform ring, however, the outer ring 302 can be made in notched shape or concavo-convex shape at the peripheral portion of the end portion thereof, when necessary. By forming it in such a shape, thermal deformation of the ring can be damped. Further, the turbulence downstream of the outer ring 302 increases, and the recirculating zone develops further. Moreover, the concavo-convex notch can be formed in the inner ring 301 side in addition to the outer ring 302.

Figure 9:
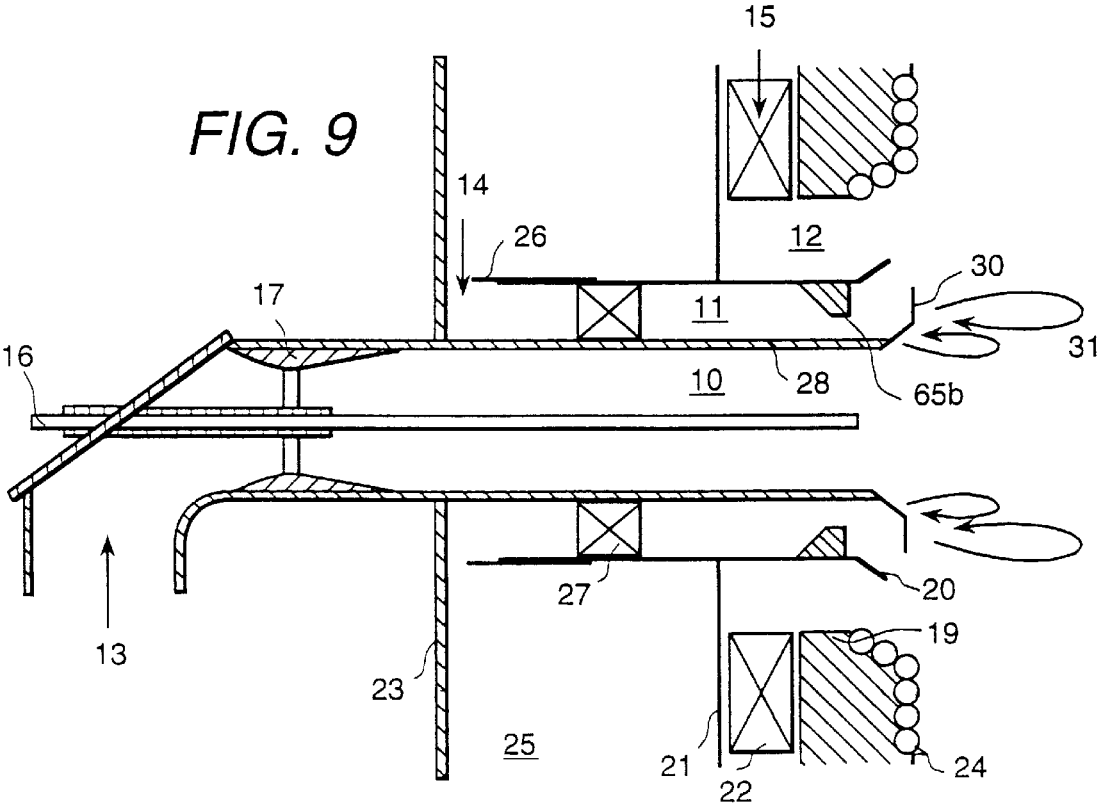
FIG. 9 is a sectional view of a pulverized coal burner of a eighth embodiment of the present invention.

An eighth embodiment of the present invention is described, referring to FIG. 9.

FIG. 9 is a sectional view of a pulverized coal burner of the eighth embodiment.

This embodiment is characterized in that the ring 30 is provided as a means for deflecting a secondary air flow jetted from the secondary air nozzle 11 to the outer periphery side of the secondary air nozzle 11 and forming a recirculating zone at a downstream side of the partition wall 28, and a plurality of narrowing portions 65*b* narrowing the flow path in the vicinity of the outlet of the secondary air nozzle 11 is provided in the peripheral direction, as shown in FIG. 9. The other structure is approximately the same as that of the sixth embodiment.

According to this embodiment, the secondary air is made faster in velocity by the narrowing portions 65*b,* and the air flow is disturbed by an expanded portion without the narrowing portions 65*b,* whereby it is possible to generate a constant turbulence of relatively large frequency. Therefore, the recirculating zone 31 formed at the downstream side develops. Further, the secondary air, the velocity of which is increased by the narrowing portions 65*b,* impinges on the the downstream end of the ring 30, whereby the velocity of flow directed to the radially outer side can be increased. Therefore, the secondary air is separated from the pulverized coal flowing at a burner central portion, and mixing of the secondary air and tertiary air with the pulverized coal can be delayed, thereby the NOx reducing zone within the flame expands, an amount of NOx formation and unburnt carbon in the combustion ashes can be effectively decreased, and it is possible to improve the ignition of pulverized coal and the stability of flame.

As mentioned above, according to the present invention, since the flow shift means for deflecting the secondary air jetted from the secondary air nozzle toward the radially outer side of the secondary air nozzle is provided, the secondary air flows toward the radially outer side, the recirculating zone formed downstream of the partition wall between the pulverized coal nozzle and the secondary air nozzle moves toward the radially outer side, and the scale thereof also can be enlarged. As a result, mixing of pulverized coal and secondary air and tertiary air in the vicinity of the burner is suppressed, the pulverized coal burns under the condition of low oxygen concentration atmosphere in the vicinity of the burner, and NOx formation can be effectively decreased.

What is claimed is:

1. A pulverized coal burner comprising a pulverized coal nozzle for jetting or spouting a mixture of pulverized coal and primary air, a secondary air nozzle concentrically arranged around the outer periphery of said pulverized coal nozzle, a tertiary air nozzle concentrically arranged around the outer periphery of said secondary air nozzle and an expanded portion at a downstream end of an outer peripheral wall of said secondary air nozzle, wherein a flow shift means for shifting secondary air jetted from said secondary air nozzle toward a in a radially outward direction is provided, said flow shift means having a downstream end positioned further downstream than said downstream end of the outer peripheral wall of said secondary air nozzle, and for shifting the secondary air to flow while the flow is being deflected at an angle greater than 60° and not greater than 90° through said expanded portion with respect to the central axis of said pulverized coal burner.

2. A pulverized coal burner according to claim 1 wherein said flow shift means comprises a guide plate provided at said downstream end of an inner peripheral wall of said secondary air nozzle, said guide plate being arranged at an angle greater than that of said expanded portion.

3. A pulverized coal burner according to claim 2, wherein said guide plate is at an angle with respect to the central axis of said pulverized nozzle, the angle being in a range greater than 60° and not greater than 90°.

4. A pulverized coal burner according to claim 2, wherein the end of said guide plate is positioned further downstream than the end of said expanded portion provided at the end of the outer peripheral wall of said secondary air nozzle.

5. A pulverized coal burner according to claim 1, wherein said flow shift means comprises a gas jet nozzle for jetting a gas toward the secondary air so that the secondary air flowing in said secondary air nozzle is shifted in a radially outward direction.

6. A pulverized coal burner according to claim 1, wherein said tertiary air nozzle is provided with a swirler for swirling and jetting the tertiary air.

7. A pulverized coal burner according to claim 1, wherein said expanded portion is provided at the end of a partition wall separating said secondary air nozzle and said tertiary air nozzle, whereby each of the end portion of the outer peripheral wall of said secondary air nozzle and the end portion of an inner peripheral wall of said tertiary air nozzle are expanded.

8. A pulverized coal burner according to claim 1, wherein a flow path narrowing obstacle for narrowing the flow path of said secondary air nozzle to cause an air flow velocity to be faster is provided in the air flow path of said secondary air nozzle.

9. A pulverized coal burner according to claim 8, wherein said flow shift means for shifting the secondary air in a radially outward direction is provided downstream of said flow path narrowing obstacle arranged in said secondary air nozzle.

10. A pulverized coal burner according to claim 8, wherein said flow path narrowing obstacle is provided on the inner peripheral wall of said secondary air nozzle.

11. A pulverized coal burner according to claim 1, wherein an end portion of said tertiary air nozzle is outwardly expanded.

12. A pulverized coal burner comprising a pulverized coal nozzle for jetting or spouting a mixture of pulverized coal and primary air, a secondary air nozzle concentrically arranged around the outer periphery of said pulverized coal nozzle, a tertiary air nozzle concentrically arranged around the outer periphery of said secondary air nozzle, and an expanded portion at a downstream end of an outer peripheral wall of said secondary air nozzle, wherein a flow shift means for shifting secondary air jetted from said secondary air nozzle in a radially outward direction is provided, said flow shift means shifting the secondary air to flow while being at an angle greater than 60° and not greater than 90° with respect to the central axis of said pulverized coal burner along said expanded portion, and wherein said flow shift means comprises a guide member for guiding the secondary air to be shifted toward the outer peripheral wall, said guide member having a downstream end positioned further downstream than said downstream end of the outer peripheral wall of said secondary air nozzle.

13. A pulverized coal burner comprising a pulverized coal nozzle for jetting or spouting a mixture of pulverized coal and primary air, a secondary air nozzle concentrically arranged around the outer periphery of said pulverized coal nozzle, a tertiary air nozzle concentrically arranged around the outer periphery of said secondary air nozzle, and an expanded portion at a downstream end of an outer peripheral wall of said secondary air nozzle, wherein a flow shift means for shifting secondary air jetted from said secondary air nozzle in a radially outward direction is provided, said air flow shift means shifting the secondary air to flow along said expanded portion, said flow shift means comprising a guide plate provided at the downstream end of the inner peripheral wall of said secondary air nozzle, said guide plate being arranged at an angle greater than that of said expanded portion; and wherein the end of said guide plate is positioned further downstream than the end of said expanded portion provided at the end of the outer peripheral wall of said secondary air nozzle, and wherein a distance between the end of of said guide plate and said expanded portion formed on the outer peripheral wall of said secondary air nozzle is in a range of 5 to 50 mm.

14. A pulverized coal burner comprising a pulverized coal nozzle for jetting or spouting a mixture of pulverized coal and primary air, a secondary air nozzle concentrically arranged around the outer periphery of said pulverized coal nozzle, a tertiary air nozzle concentrically arranged around the outer periphery of said secondary air nozzle, and an expanded portion at the end of an outer peripheral wall of said secondary air nozzle, wherein an obstacle is provided at a tip of a partition wall partitioning said pulverized coal nozzle and said secondary air nozzle, said obstacle having a first plane perpendicular to a primary air flow and a second plane perpendicular to a secondary air flow, said second plane being arranged at the most downstream end portion of said obstacle, and said first plane being arranged at an upstream side of said second plane of said obstacle.

* * * * *